US005855505A

United States Patent [19]

Letts

[11] Patent Number: 5,855,505

[45] Date of Patent: Jan. 5, 1999

[54] SURFACE LEVELING TOOL

[76] Inventor: Joshua E. Letts, 10807 NE 76th. St., Vancouver, Wash. 98662

[21] Appl. No.: 865,105

[22] Filed: May 29, 1997

[51] Int. Cl.[6] ..... B24B 15/04

[52] U.S. Cl. ..... 451/523; 451/550; 451/524; 451/352; 451/355

[58] Field of Search ..... 451/523, 350, 451/352, 355, 354, 524; 7/165

[56] References Cited

U.S. PATENT DOCUMENTS

| | | | |
|---|---|---|---|
| 1,250,328 | 12/1917 | Langford | 7/165 |
| 1,501,192 | 7/1924 | Severns | 451/524 |
| 2,429,550 | 10/1947 | Hein | 451/524 |
| 3,483,662 | 12/1969 | Ames | 451/524 |
| 3,842,548 | 10/1974 | Stoneburner | 451/524 |
| 3,964,213 | 6/1976 | Tobey | 451/524 |
| 4,200,948 | 5/1980 | Nesseth . | |
| 4,414,700 | 11/1983 | Burns . | |
| 4,475,317 | 10/1984 | Dicke | 451/523 |
| 4,517,770 | 5/1985 | Pinto . | |
| 4,937,984 | 7/1990 | Taranto | 451/524 |
| 5,179,807 | 1/1993 | Gupton . | |
| 5,193,313 | 3/1993 | Sanchez et al. | 451/524 |
| 5,245,797 | 9/1993 | Milkie . | |
| 5,309,598 | 5/1994 | Carpenter . | |
| 5,471,698 | 12/1995 | Francis et al. . | |
| 5,634,843 | 6/1997 | Liu | 451/524 |

*Primary Examiner*—Robert A. Rose
*Assistant Examiner*—George Nguyen
*Attorney, Agent, or Firm*—Richard C. Litman

[57] ABSTRACT

A surface leveling tool for sanding wooden, painted and plastic surfaces without gouging. The tool comprises a handle of variable length attached to a head with a clamping element which holds a flexible plastic sandpaper insert. A specially formatted sandpaper sheet is adhered to the flexible plastic insert. The plastic insert has a cross-section analogous to a J-shape and is clamped only by the hooked portion. This arrangement provides for space between the unclamped portion of the sandpaper covered insert and the clamp. The clamp utilizes fasteners which are tightened. and loosened by a hidden screwdriver in the grip of the handle.

12 Claims, 2 Drawing Sheets

SURFACE LEVELING TOOL

BACKGROUND OF THE INVENTION

1. Field of the Invention

The present invention relates to a surface leveling tool which will not gouge the surface being sanded. Surfaces such as wood, plastic, paint and the like can be sanded by this tool with a flexible sanding head. Preferably, the tool is utilized in the placement of a plasticized sheet of flooring such as vinyl or linoleum over an existing deteriorated plasticized flooring.

Conventionally, a cement patch composition (plastic) is deposited over the old floor covering and troweled to a 1/16 to 3/8 inch thickness and allowed to cure for 1/2 to 1 hour. The cured cement patch composition functions to fill any existing cracks and uneven surfaces in the old floor covering. The cured cement surface of the patch, however, must still be smoothed in order to lay further adhesive for the new flooring sheet to adhere properly to the underlayment. The present invention permits the sanding of irregular surfaces in the cement patch, even under cabinets or the like, right up to the toe-kick molding.

The tool comprises a sandpaper surface applied to a J-shaped (cross-section) plastic insert support to form a sandpaper block which is clamped into the holder element by removable fasteners. The holder element has a handle which can vary from 6 inches to 6 feet. A removable terminal handle grip has a screwdriver insert for tightening or loosening the fasteners for replacement of a worn sandpaper block.

2. Description of the Related Art

The related art shows various forms of sanding tools. The art of interest will be discussed in the order of their perceived relevance to the present invention.

U.S. Pat. No. 5,471,698 issued on Dec. 5, 1995, to Paul, S. Francis et al. describes a hand tool having interchangeable accessories and a pivoting head. The frame has a hand grip bar and an arm brace for applying a downward force to the tool. The sandpaper is removably attached to a detachable flat baseplate made of rubber. There is no suggestion for adhering the sandpaper to the baseplate or to make the baseplate curvilinear as in the present invention. Moreover, the pivoting head is thick and would not reach the limited areas under kitchen floor cabinets with toe kicks.

U.S. Pat. No. 5,179,807 issued on Jan. 19, 1993, to Donald W. Gupton describes a floor sanding device comprising a large rectangular pivoting shoe member (21.5 in. long and 1 ft. wide) attached to a long handle with an eye for a hand hold by a standing worker. The sandpaper sheet is attached to the shoe member at the front and the rear by six bolts with wingnuts. The cushioning member between the sandpaper sheet and the shoe member can be either sponge rubber or a synthetic foam. The thickness of the shoe member is increased in front and would not be suitable for cramped spaces, especially with three protruding wingnuts. The present invention requires a resilient sandpaper block unattached at the rear, which feature Gupton does not have or suggest.

U.S. Pat. No. 4,200,948 issued on May 6, 1980, to Arthur E. Nesseth describes a T-shaped planar paint scraper with a removable and reversible blade which has a smooth edge on one side and a toothed, serrated edge on the opposite side. The scraper blade is inserted into a slot and cannot be converted into a sandpaper edge.

U.S. Pat. No. 4,517,700 issued on May 21, 1985, to Joseph G. Pinto describes an adjustable scraper and sanding tool having a rectangular prismatoid housing pivoting on a grooved tubular handle which is threaded for insertion of a pole. A scraping element is attached to the handle and employed by turning the tool upside down. A clip-on support member with a pad apparently can support a sandpaper sheet over the clips. The presence of the scraper blade and the depth of the housing would prevent the use of this tool for narrow spaces.

U.S. Pat. No. 5,245,797 issued on Sep. 21, 1993, to Terry H. Milkie describes a manual sander for hookup to a vacuum source such as a household vacuum cleaner. The sander comprises a hollow housing (with a hollow handle) which accommodates a pivoting hook and threaded socket for a pole. The flat base portion has a sponge foam pad glued to its bottom for supporting a sandpaper sheet. The sandpaper sheet is held down in front and in the rear with an inverted box member and a wing nut on a bolt. The sander has a high profile and would not be suitable for sanding in narrow spaces. Moreover, the tool is intended for sanding high walls without resorting to stepladders.

U.S. Pat. No. 5,309,598 issued on May 10, 1994, to Joyce A. Carpenter describes a paint scraper kit having various scraper blade shapes and corresponding handles. The blades can have triangular, square and intersecting plate-like configurations. The scraping portions are a matrix of sharp projections. The handles can be curved or straight knobs which are removable with a lug and. a bore system. There is no suggestion for adding a sanding feature to the paint scraper kit.

U.S. Pat. No. 4,414,700 issued on Nov. 15, 1983, to Fredrick B. Burns describes a device for preparing a wall surface for painting. The square base member has a short handle connectable to a long pole for treating wall surfaces at a height. The handle has two parts which are the gripping member (cylindrical) and the connecting portion attached to the square base member. The handle pivots in the connecting portion. A scraper blade is positioned on the gripping member for use when the base member is apparently inverted. A square plate has front and end flanges for positioning on the base member. On the square plate is attached a square foam sponge having a fibrous surface surrounding a square surface of a nylon fiber containing abrasive cleaning particles. The two regions can be reversed. When any cleaning fluid is added to the sponge, the scrubbing of a painted wall can commence. There are no suggestions for utilizing sandpaper and for leveling floor material.

None of the above inventions and patents, taken either singularly or in combination, is seen to describe the instant invention as claimed. Thus, a floor leveling tool solving the aforementioned problems is desired.

SUMMARY OF THE INVENTION

The present invention is directed to a general sanding tool for finishing surfaces of wood, paint, plastic, laminate and the like. The sanding tool will not make gouges in the sanded surfaces due to its unique construction. More particularly, the tool is valuable for smoothing out the cured cement patch utilized when covering deteriorating floor covering with a new vinyl floor covering. A curved plastic insert is covered with a sandpaper sheet by adhesive and clamped in a holder. The holder is attached to a tubular handle of variable length. The handle has a grip with a screwdriver tip which is inserted in the handle for use in releasing or tightening the clamp in the holder when replacing used sandpaper. The curved plastic insert provides a flexible sanding surface and access to narrow spaces.

Accordingly, it is a principal object of the invention to provide a sanding tool which will not gouge the surface being sanded.

It is a further object of the invention to provide a sanding tool with a flexible sanding surface.

Still another object of the invention is to provide a curvilinear plastic insert with a sandpaper covering.

It is another object of the invention to provide a floor leveling tool for smoothing the cured cement patch over a deteriorated floor covering.

It is an object of the invention to provide improved elements and arrangements thereof in a surface leveling tool for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a sanding tool which will not gouge the surface being sanded due to the flexible sanding insert. The sanding insert is made from plastic which has rigidity but can flex under pressure in the space provided by the holder element. The tool can be used to sand any extended surface such as a floor, wall or ceiling with the use of a handle of various lengths. The material being sanded can be varied, e.g., wood, paint or plastic. Replacement of the novel sanding insert is convenient. The addition of a screwdriver-containing hand grip enables the changing procedure to be quickly performed.

Figure 1:
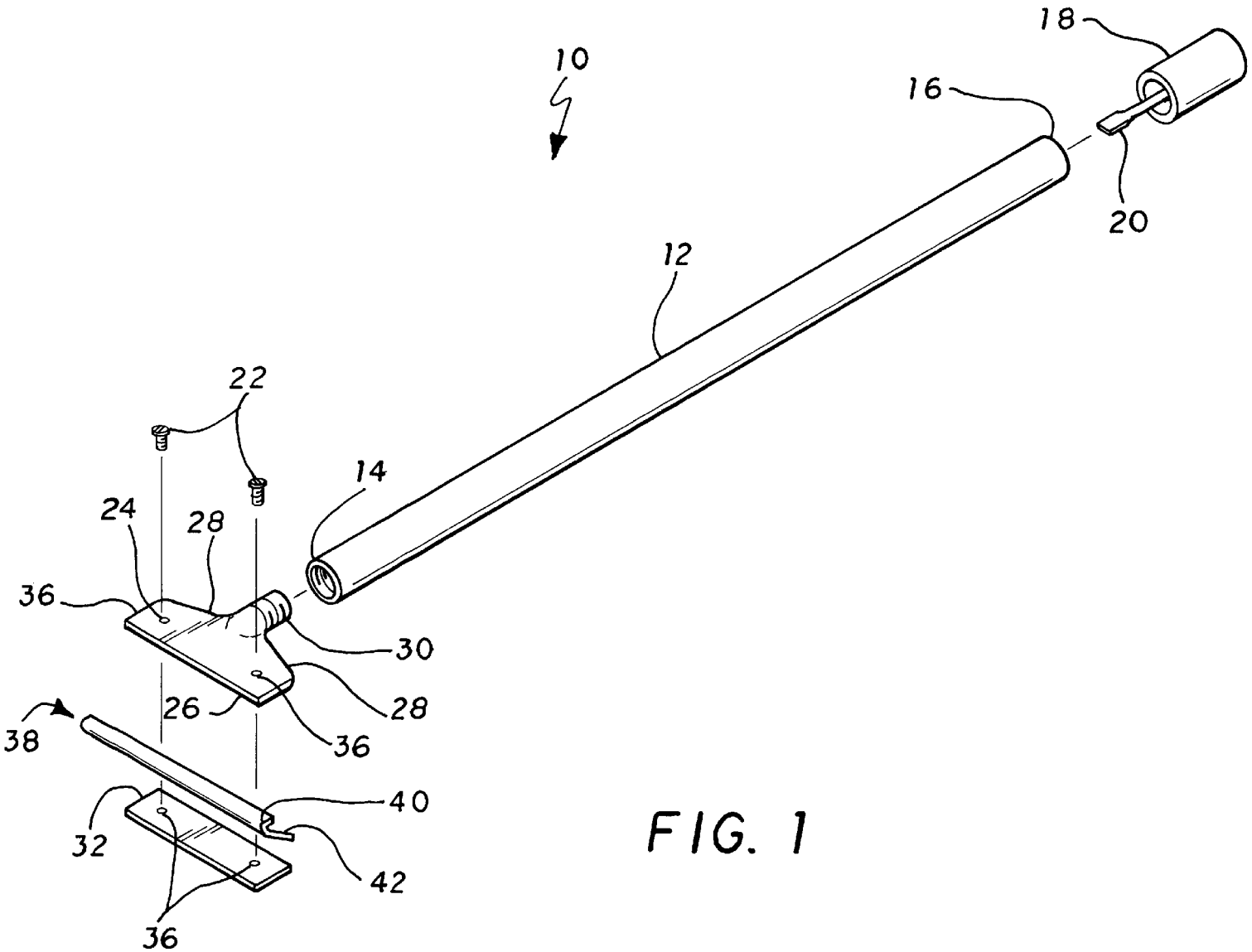
FIG. 1 is an exploded perspective view of a floor leveling tool according to the present invention.

FIG. 1 is an exploded view of the present invention illustrating the parts of the surface leveling tool 10. A handle 12 has a threaded proximate end 14 and a hollowed distal end 16. The handle 12 can be hollow throughout. A grip 18, preferably rubber, has a screwdriver 20, flat edged or Phillips headed (not shown), for use on the fasteners or bolts 22 in the head element 24. The head element has a threaded neck portion 30 for attachment. to the handle 12. Although the connection is shown as threaded, it is contemplated that a friction fitting or a welded connection can be employed. Moreover, the handle 12 can be metal or plastic of variable length from 6 inches to 6 feet and ⅝ to ¾ inch in diameter. The grip can be made of rubber 5 to 6 inches long and 1 inch in diameter.

The head element 24 has a straight front edge 26 with sloped sides 28 ending in a neck portion 30. As noted above the neck portion can be threaded or smooth on the outside. Underneath the head element 24, a rectangularly shaped clamping element 32 is supported by two threaded bolts 22 fitting in throughbores 36 in both elements. The head element 24 and the clamping element 32 are of a size that there is adequate clearance for the bolts 22 to connect these two elements without penetrating a flexible sandpaper support element 38 which is clamped. It should be noted that the rear edge of the clamping element 32 can be hinged (not shown) to the head element 24.

Figure 2:
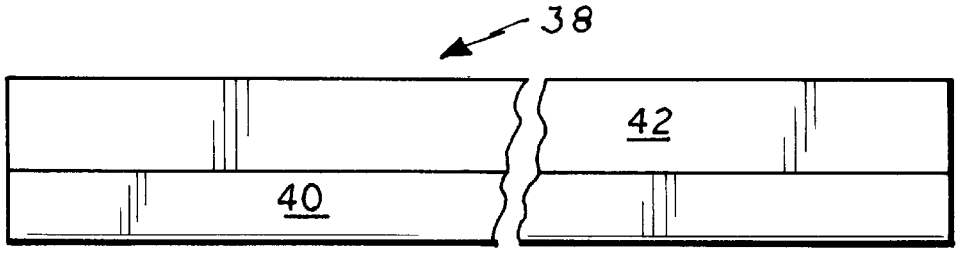
FIG. 2 is a plan view of the sandpaper support element of the present floor leveling tool.
Figure 3:
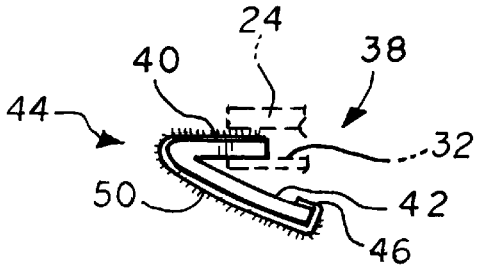
FIG. 3 is side view of the sandpaper support element shown in FIG. 2 covered by the sandpaper sheet and clamped between the head element and the clamping element.

The essence of the present invention is the flexible sandpaper support 38 which has a rectangular shape approximately 4.5 inches long and a width of 0.75 inch as shown in top view in FIG. 2. A side view of the sandpaper support 38 in FIG. 3 illustrates a. cross-section in the shape of a "J" with a hook portion 40 approximately ⅜ inch and a curvilinear portion approximately ¾ inch long. The flexible support 38 can be vinyl rubber or the like. These dimensions are only exemplary and can be increased proportionately to the size of the head element.

The sandpaper sheet 44 (shown in partial cross-section) with its abrasive edge of the abrasive portion 50 (see FIG. 4) is adhered to the hook portion 40 over the sandpaper support 38 and overlaps the edge of the curvilinear portion 42 so as to adhere the unabrasive long border 46 on the rear surface of the sandpaper support 38. The non-abrasive side borders 48 also overlap the side edges of the sandpaper support 38. The hook portion 40 of the sandpaper support 38 is then clamped between the head element 24 (shown in shadow) and the clamping element 32 (shown in shadow) to permit a continuing space between the clamping element 32 and the sandpaper element 44 while undergoing the sanding process.

Figure 4:
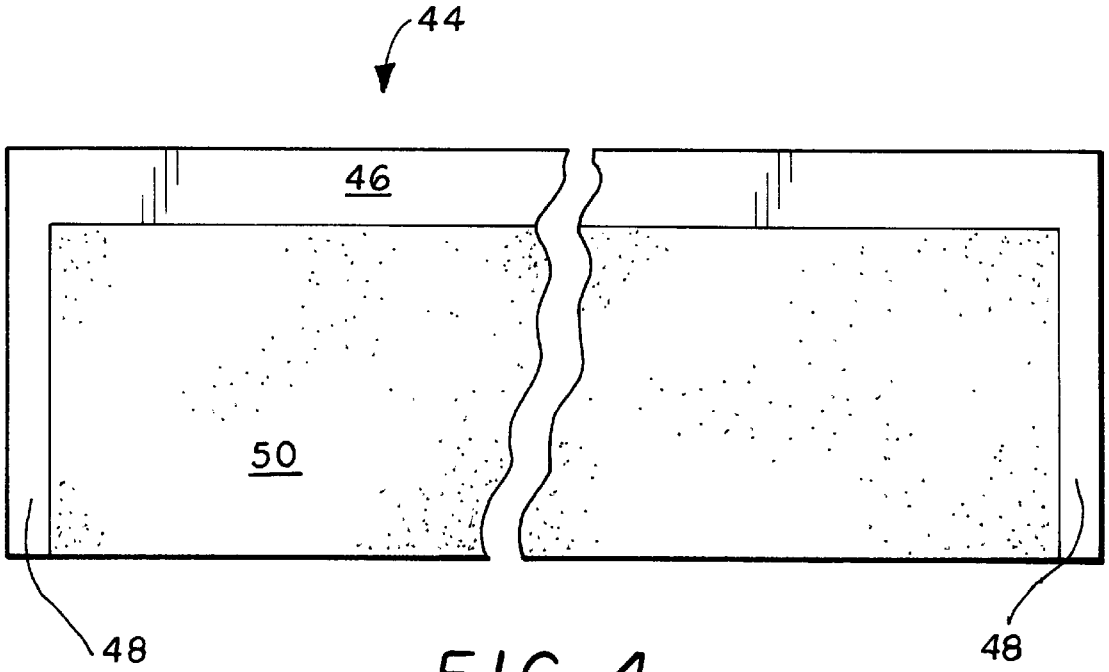
FIG. 4 is a plan view of a sheet of sandpaper before application to the sandpaper support element.

FIG. 4 depicts the specially configured sandpaper sheet 44 which is affixed to the sanding side of the sandpaper support 38 The rectangular sheet is approximately 5.25 inches long and 2 inches wide. The rectangular sheet 44 has a long border 46 of approximately 0.5 inch in width and side borders 48 approximately 3/16 inch in width. The abrasive portion 50 is thus bordered only on three contiguous sides which overlap the sandpaper support 38 when adhesive is applied. Since only the hook portion 40 of the support 38 is inserted and held by the clamping element 32 against the head element 24, there is no need for a border on this edge of the hook portion 40. The curvilinear portion 42 of the sandpaper support 38 and its coated sandpaper sheet 44 can now function as a flexible sandpapering element due to the space provided between the clamping element 32 and the curvilinear element 42 of the sandpaper support 38 to prevent gouging of the surface being abraded.

The abrasive sandpaper sheet 44 can be 36 to 80 grit for the purposes designed for this non-gouging sandpaper tool 10. Sandpaper support elements 38 with sandpaper elements 44 of varying grits can be readily replaced for the specific job and when the sandpaper is worn down.

A particular use of the innovative tool will serve as an example of its value. A deteriorating plastic floor covering with an embossed or cracked surface in a kitchen must be covered with a new vinyl floor sheet. A coating of cement patch composition must be troweled over the existing floor covering 1/16 to ⅛ inch. thick and cured for 0.5 to 1 hour. There are floor cabinets extending several inches over the floor and the with toekick molding. The cement patch composition comes within an inch of the toekick molding. Now, the surface leveling tool 10 of the present invention with a short handle 12 must abrade the cured cement patch composition under the overhang of the floor cabinets as well as the exposed walking surface. As the tool 10 is pressed onto the floor under the overhang of the cabinets, the flexible sandpaper support element is pressed against the clamping element 32 for further support. Thus, the cured cement patch composition is leveled throughout the kitchen floor.

Replacement of a worn sandpaper element 44 can be readily performed by loosening the clamping element 32. A longer handle 12 can be utilized for the exposed areas by a standing worker. An adhesive is then applied, and the new vinyl flooring is laid down to form a smooth covering absent any uneven surfaces due to the embossment or other surface irregularities in the underlayment.

The present inventive tool can be used to sand walls and ceilings covered with peeling paint, sand wood floors, sand laminated surfaces and the like without any fear of gouging or pitting the surface being abraded.

It is to be understood that the present invention is not limited to the embodiment described above, but encompasses any and all embodiments within the scope of the following claims.

I claim:

1. A surface leveling tool comprising:

a handle with a longitudinal axis, a proximate end and a distal end;

a head element having a front side, a rear side, a topside, and an underside, and the rear side having an extension attachable to the proximate end of the handle along said longitudinal axis of said handle;

a planar clamping element, substantially commensurate in shape with said head element, and attachable to the underside of said head element;

a rectangularly shaped sandpaper element; and a rectangularly shaped flexible support element having a J-shaped cross-section and a hook portion for supporting said sandpaper element;

whereby the hook portion of the flexible support element supporting the sandpaper element is held by the clamping element to permit a space between the clamping element and the sandpaper element for sanding surfaces without gouging.

2. The floor leveling tool as defined in claim 1, further comprising a grip, removably attachable to the distal end of the handle.

3. The surface leveling tool as defined in claim 2, said handle having means defining a hollow therein, and wherein said grip contains a screwdriver fitting into said hollow of the handle at the distal end.

4. The surface leveling tool as defined in claim 1, wherein said handle is hollow.

5. The floor leveling tool as defined in claim 1, further comprising a plurality of fasteners located in the head element, for fastening the clamping element to the head element.

6. The floor leveling tool as defined in claim 1, the sandpaper element comprising an abrasive portion, bordered on three sides with a non-abrasive margin.

7. The floor leveling tool as defined in claim 6, including adhesive, wherein the sandpaper element is supported by the flexible support element by said adhesive.

8. The floor leveling tool as defined in claim 6, there further being means defining a threaded connection for interconnecting the head element and the handle.

9. The floor leveling tool as defined in claim 6, including a friction fitting connection, the head element and the handle being attached by said friction fitting connection.

10. The floor leveling tool as defined in claim 6, wherein the sandpaper support element is made of vinyl rubber.

11. A flexible sandpaper support element for a sanding tool comprising:

a rectangularly shaped sandpaper element of one size having an abrasive surface portion bordered on three sides by a margin devoid of abrasive material;

a rectangularly shaped flexible support element of a smaller size having a J-shaped cross-section and a hook portion with an outside surface; and the sandpaper element of one size being secured to the flexible support of a smaller size on an outside surface, to form a flexible sandpaper support element for a sanding tool.

12. The flexible sandpaper support element as defined in claim 11, wherein the sandpaper support element is made of vinyl rubber.

* * * * *